US005579952A

United States Patent [19]

Fiedler et al.

[11] Patent Number: 5,579,952

[45] Date of Patent: Dec. 3, 1996

[54] VENDING APPARATUS FOR DISPENSING HOT-FOOD TRAYS

[75] Inventors: Armin Fiedler, Chicago; Scott Fiedler, Palatine, both of Ill.

[73] Assignee: Automeal, Inc., Chicago, Ill.

[21] Appl. No.: 434,373

[22] Filed: May 3, 1995

[51] Int. Cl.[6] ..... A24F 27/14

[52] U.S. Cl. ..... 221/150 A; 221/249; 219/521

[58] Field of Search ..... 221/150 H, 150 HC, 221/124, 127, 249, 247; 312/35; 99/357, 352; 219/214, 521, 522

[56] References Cited

U.S. PATENT DOCUMENTS

| | | | |
|---|---|---|---|
| D. 186,285 | 10/1959 | Koch | D52/3 |
| D. 194,065 | 11/1962 | Gran | D52/3 |
| 2,671,001 | 3/1954 | Ossanna, Jr. | 312/36 |
| 2,901,964 | 9/1959 | Johnson | 99/352 |
| 3,164,294 | 1/1965 | Phillips et al. | 221/84 |
| 3,651,752 | 3/1972 | Roslonski | 221/150 HC |
| 3,653,541 | 4/1972 | Crum | 221/150 HC |
| 3,940,016 | 2/1976 | Krakauer | 221/129 |
| 4,194,109 | 3/1980 | Springer | 219/521 |
| 4,495,402 | 1/1985 | Bundick et al. | 221/150 A |
| 4,592,485 | 6/1986 | Anderson et al. | 221/150 |
| 4,700,869 | 10/1987 | Bogner | 221/249 |
| 5,147,068 | 9/1992 | Wright | 221/9 |
| 5,245,150 | 9/1993 | Grandi | 219/10.55 R |

FOREIGN PATENT DOCUMENTS

| | | | |
|---|---|---|---|
| 164962 | 9/1955 | Norway | 219/214 |

*Primary Examiner*—Kenneth Noland

*Attorney, Agent, or Firm*—Milton S. Gerstein; Marvin N. Benn

[57] ABSTRACT

A vending apparatus for dispensing trays of hot food is provided with a vertical stack of the compartments for storing and heating the trays of food. Each compartment has a lower support-shelf, under which is an electrical, coil-resistance heater for keeping the food in the tray at a temperature of about 150 degrees F. Opening of the door of a compartment causes the opening of a micro-switch associated with the selected compartment, which opening causes power to be shut off to the solenoid of the compartment. Operatively associated with each compartment is a push-mechanism that causes the selected tray to be partially pushed out of its compartment when the associated door is manually opened. Each push-mechanism has a push-rod coupled through suitable linkage to the door, which push-rod contacts the rear surface of the selected tray for pushing it out as the door is opened. The door is only capable of being partially opened, such that it forms an acute angle with respect to the horizontal, so that the push-rod is not capable of accidentally pushing the tray completely out of the compartment and onto the floor. A self-closing mechanism automatically closes the opened door after the selected tray has been removed and the door released by the customer.

45 Claims, 9 Drawing Sheets

81
84
82
82'

9
9
58
54'
54
18
52'
20
52
44
82'
82
84
81
16
44
36
22
44'

VENDING APPARATUS FOR DISPENSING HOT-FOOD TRAYS

BACKGROUND OF THE INVENTION

The present invention is directed to a vending apparatus for dispensing food-trays, and especially hot food-trays. The invention is directed to such an apparatus that dispenses one tray of food in response to a coin, coins or tokens being inserted into a slot of the apparatus.

The apparatus of the invention has an intended use in any environment where vending machines are found, and has especial importance and relevance for use in senior citizen centers, or independent, active, retirement communities, and other food service operations, and the like, for dispensing hot-food trays to senior citizens. When the invention is used in these establishments, the vending apparatus of the invention is intended to replace, or supplement, the current practice of waiting on the senior citizens in a dining room or hall by a number of waitresses or waiters. The apparatus of the present invention is specifically intended for ease of use when removing a vending tray, and for its ability to heat and keep hot those food-vending trays placed therein until dispensed. The use of the apparatus of the invention in senior citizen centers, and the like, thus allows for a considerable reduction of personnel and employees required to serve the senior citizens residing there, and, also, engenders a sealing of self-reliance and self-worth in each person, since, owing to the ease and safeness of use the apparatus of the invention, each person is able to serve himself or herself.

Vending machines for dispensing foods and trays are, of course, well-known. Many prior-art vending apparatuses dispense hot food on trays. Examples of vending machines dispensings trays of heated food are shown in U.S. Pat. Nos 4,592,485; 5,147,068; and 5,245,150. Each of these patents discloses a vending machine that dispenses a tray of food. Before dispensing the tray, the food in the tray is heated by a microwave oven that is moved to the location of the chosen, or vended, tray picked by the customer. When the microwave oven is positioned at that location, the tray is pushed into the interior of the microwave oven, whereupon it is heated, and, thereafter, the tray is delivered or dispensed to the customer. Above-mentioned U.S. Pat. No. 5,245,150 discloses that, instead of using a translating microwave oven for heating the food in each vended tray, each compartment, in which is placed a vending tray of food, may be associated with its own heating unit to the rear of the compartment, with a moving mechanism moving the tray into and out of the oven and then out of its compartment for taking by the customer, thus obviating the need for transporting one microwave oven from one shelf to the next for each tray vended. These prior-art apparatuses are used for heating or reheating the food in the tray after the tray has been selected, or vended. Thus, the oven, or other heating elements, are not energized or used until a specific tray has been selected during the vending operation. Only after the specific tray of food has been selected does the heating unit or microwave oven then heat the food, for subsequent dispensing thereafter. If the meal being dispensed contains meat, milk dishes, and other perishable foods, then the cabinet of the vending machine must be refrigerated.

The vending apparatus of the present invention dispenses trays of hot food, such as meat, milk dishes, and other perishable foods, but does not refrigerate the cabinet of the apparatus, since the food of each tray is kept hot continuously by individual heating units associated with each dispensing compartment of the apparatus.

Since the vending apparatus of the invention has especial, intended applicability for use by senior citizens, it is imperative that when the tray of hot food is dispensed, it is dispensed in a safe manner and in a way that allows one to remove the tray from its compartment in an as easy a manner as possible. Prior-art dispensing machines typically allow one to open the door of the vended compartment, requiring one to reach into the compartment in order to pull the vended tray out. If the tray, and, therefore, the compartment itself, is hot, there is an ever-present chance that one may burn himself, or drop the tray during removal of the tray, which is ever-more likely to occur when a senior citizen is removing the tray.

SUMMARY OF THE INVENTION

It is, therefore, the primary objective of the present invention to provide a vending apparatus for dispensing trays of hot food, which vending apparatus contains a plurality of shelves for storing the trays, with each tray individually heated by a heater under the shelf itself.

It is yet another objective of the present invention to provide a vending apparatus for dispensing trays of hot food, which apparatus will push out the selected, vended tray such that the customer need not reach inside the hot tray-compartment.

It is another objective of the present invention to provide a vending apparatus for dispensing trays of hot food, where each tray-compartment has a manually-opened door, which door is operably coupled to a pushing mechanism that pushes out the selected, vended tray as the customer opens the door, so that the tray is forced out in response to the manual opening of the door by the customer himself.

It is an objective of the present invention to provide a vending apparatus for dispensing trays of hot food, which apparatus has an automatic closure mechanism that automatically closes the opened door associated with the vended tray, which closure mechanism is loaded in response to the manual opening of the compartment-door, so that the door will close slowly and by itself, without the customer having to reclose the door.

It is another objective of the present invention to provide a vending apparatus for dispensing trays of hot food, where each tray-compartment has a manually-opened door that, when fully-opened, makes an acute angle with respect to the horizontal, in order to prevent the pushed-out tray from falling out of its compartment and onto the floor.

Toward these and other ends, the vending apparatus for dispensing trays of hot food is provided with a vertical stack of the compartments for storing and heating the trays of food. Each compartment has a lower support-shelf, under which is an electrical, coil-resistance heater for keeping the food in the tray at a temperature of about 150 degrees F. A temperature-sensor of a thermostat or thermostats senses the air temperature in the interior of the apparatus, which thermostat controls the actuation and de-actuation of all of the coil-resistance heaters at the same time. The lowermost compartment has a coil-resistance heater that is about 10%–20% more powerful than those of the compartments above it; this is done, since there is greater heat loss in the lowermost compartment, because there is no heated compartment below it.

Operatively associated with each compartment is a manually-opened door. The doors of the compartments are locked, and thus prevented from being opened, by a series of solenoids, one solenoid per compartment. When a solenoid is unactuated, and the door is closed, the door is locked in its closed position, until a customer inserts a token or coin into the apparatus, and selects that particular compartment by depressing a switch. This selection activates the solenoid associated with that compartment, in order to remove a latching pin from locking association with the door of the selected compartment, so that the door may be manually opened by the customer. Opening of the door causes the opening of a micro-switch associated with the selected compartment, which opening causes power to be shut off to the solenoid of the compartment. When the door is closed, the spring of the solenoid of that selected compartment again pushes out the latching pin, to again lock the door in its closed position, while the associated micro-switch is again closed, in order to allow for subsequent energization of a selected compartment-solenoid when the next customer inserts a coin or token and selects his vended compartment-tray.

Operatively associated with each compartment is a push-mechanism that causes the selected tray to be partially pushed out of its compartment when the associated door is manually opened. Each push-mechanism has a push-rod coupled through suitable linkage to the door, which push-rod contacts the rear surface of the selected tray for pushing it out as the door is opened. The door is only capable of being partially opened, such that it forms an acute angle with respect to the horizontal, so that the push-rod is not capable of accidentally pushing the tray completely out of the compartment and onto the floor.

Also operatively associated with each door is a self-closing mechanism which automatically closes the opened door after the selected tray has been removed and the door released by the customer. This self-closing mechanism is loaded each time the associated door is opened, and includes a piston-cylinder arrangement that compresses the air in the cylinder when the door is opened, so that, when the door is released, the compressed air will force the piston outwardly relative to its cylinder, thereby closing the door.

BRIEF DESCRIPTION OF THE DRAWING

The invention will be more readily understood with reference to the accompanying drawing, wherein.

DETAILED DESCRIPTION OF THE INVENTION

Figure 1:
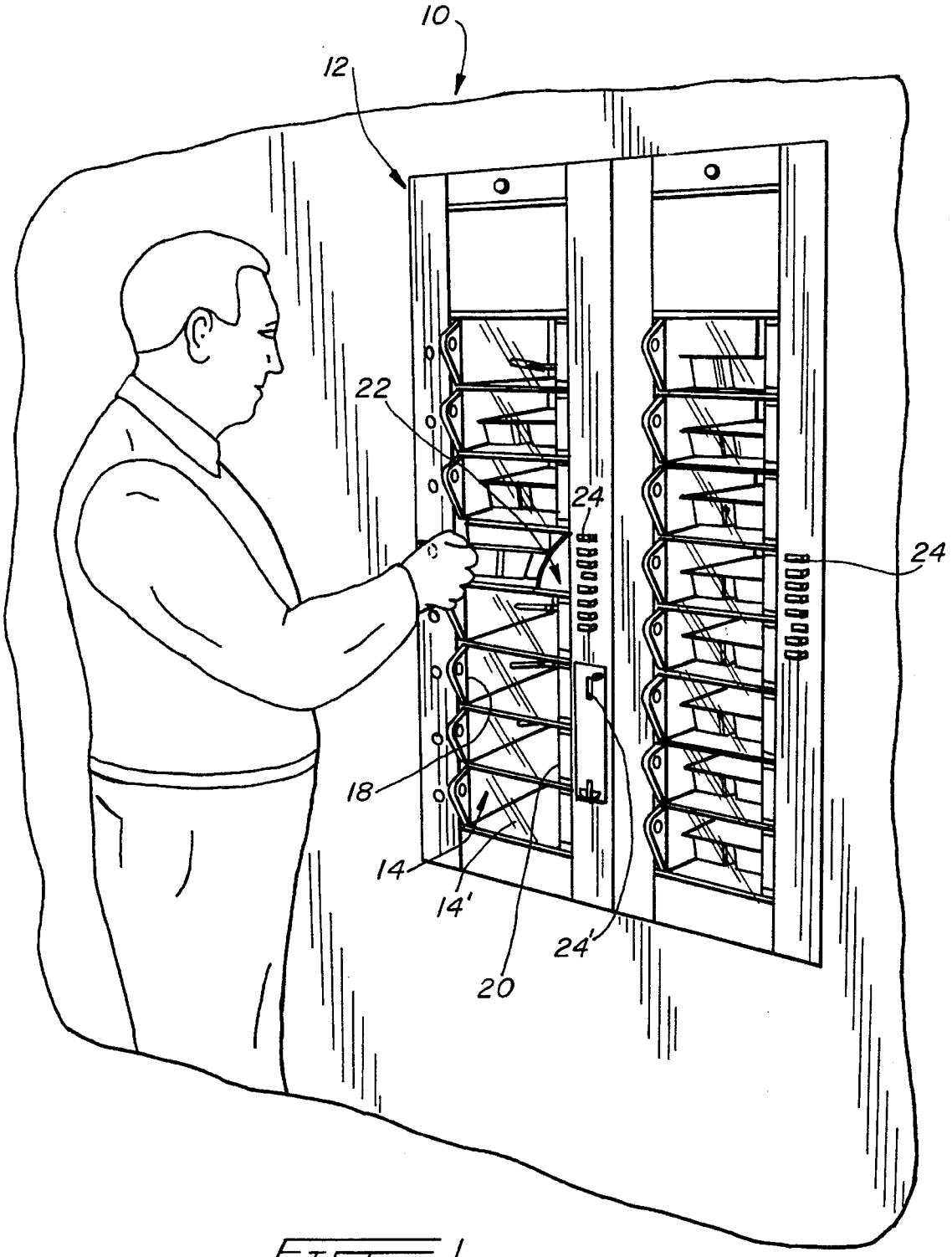
FIG. 1 is a front isometric view showing the vending apparatus of the invention.
Figure 3:
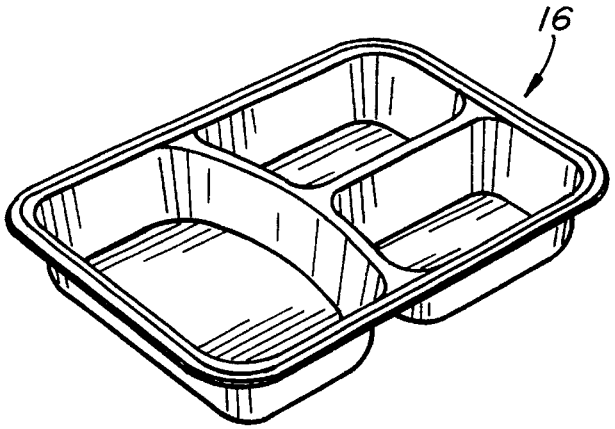
FIG. 3 is an isometric view of a tray used for storing the hot food that is vended by the apparatus of the invention.
Figure 4:
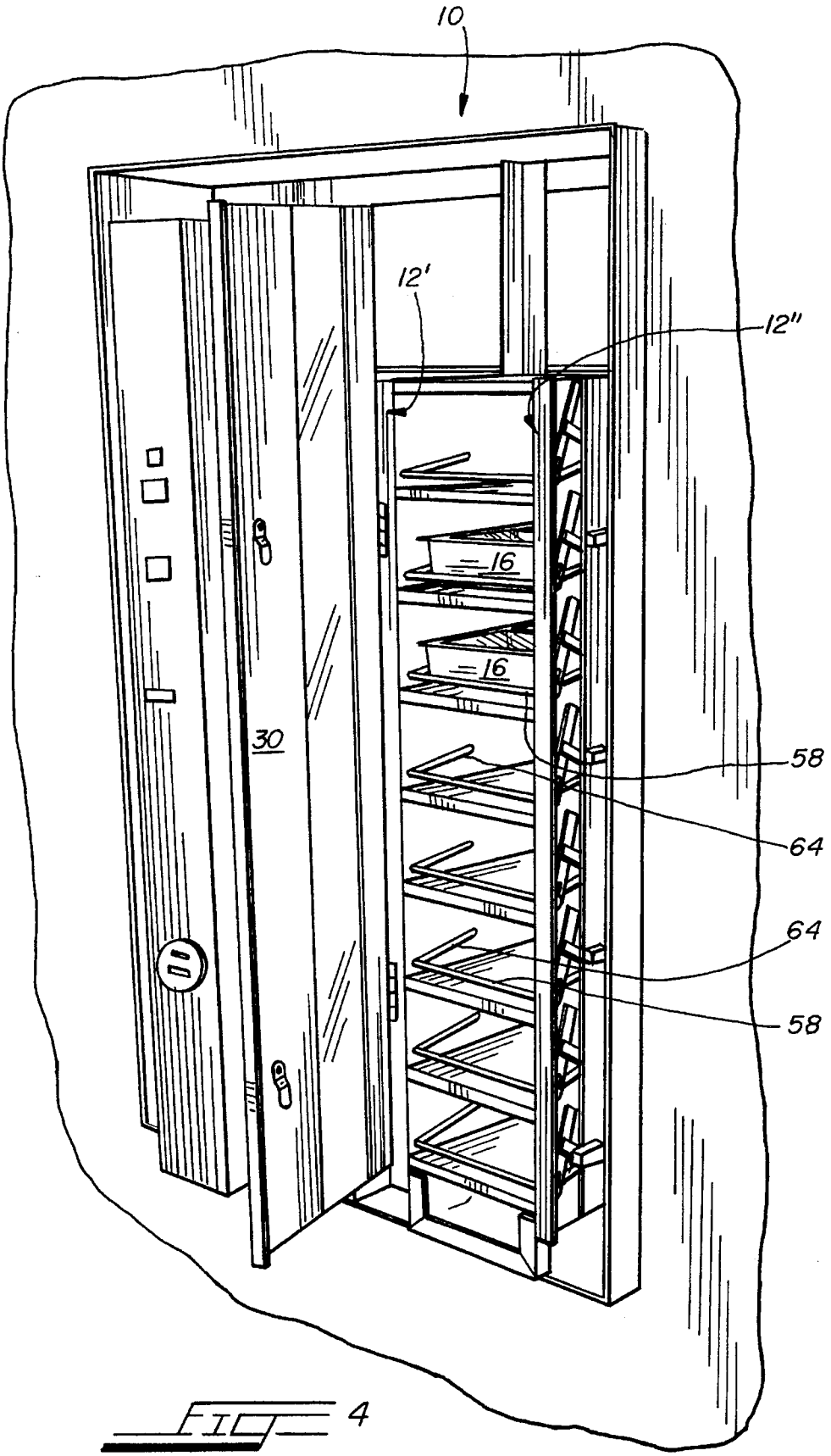
FIG. 4 is a rear, isometric view of the apparatus of FIG. 1, showing the rear loading door in its opened position for inserting new trays of food into the separate, stacked compartments of the apparatus.
Figure 5:
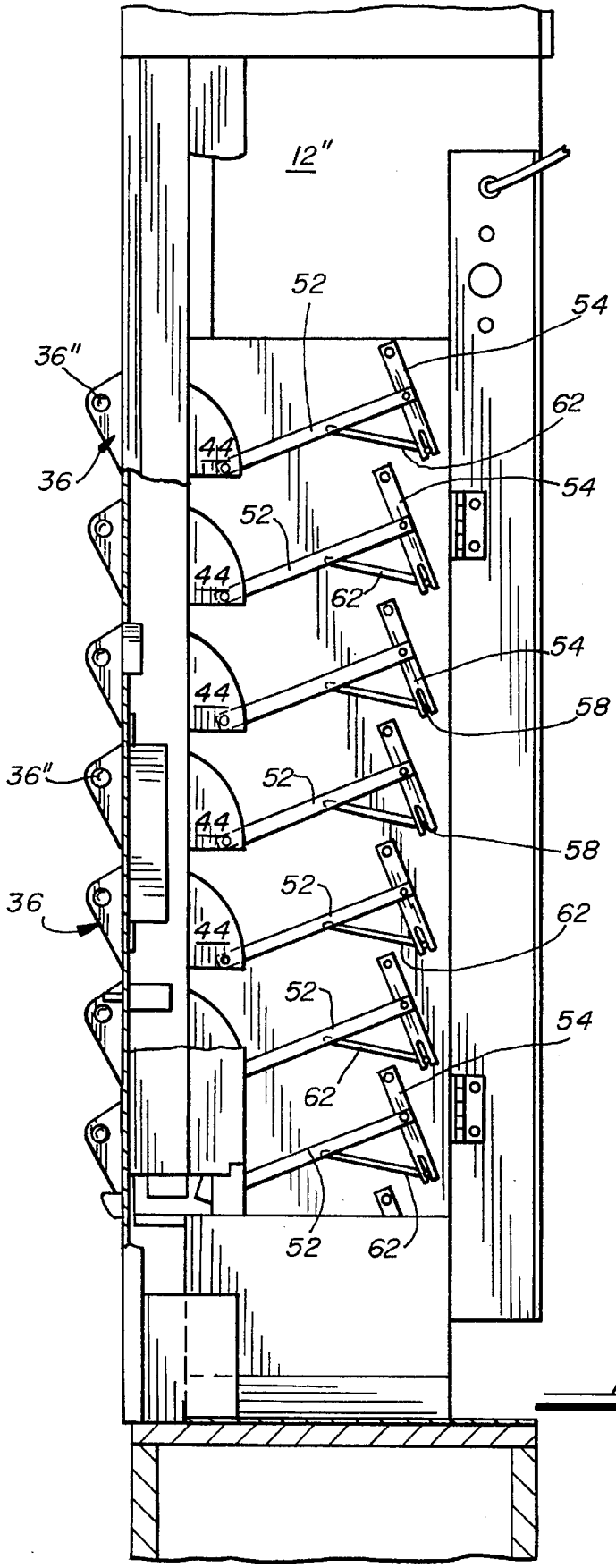
FIG. 5 is a broken-away, side elevational view of the apparatus of the invention, with the exterior side wall removed, showing the interior of the apparatus, and particularly an interior, vertical side wall which forms the side wall of the vertically-stacked compartments for storing the vending trays, there being visible the series of linkage mechanisms for pushing out a vended tray from the compartments.

Referring now to the drawings in greater detail, where like reference numerals indicate like parts, the vending apparatus of the invention is indicated generally by reference numeral 10. The apparatus 10 has a main frame 12 defining a plurality of tray-compartments 14, which are preferably arranged into two vertical stacks, as seen in FIGS. 1 and 4. Each vertical stack is defined by a pair of interior side walls 12', 12" of the main frame Each tray-compartment has a horizontal shelf 14' made of metal, upon which rests a food-tray 16 (FIG. 3), which food-tray 16 is made of suitable material for storing hot food therein. Each tray-compartment 14 also has a pair of insulated side walls 18, 20 that form a section of the main frame's inner side walls 12', 12", and a front, pivoted, pull-down door 22 with a central transparent window for viewing the contents of the compartment, which door, when opened, allows access to the interior of the tray-compartment for pulling out the food-tray. The apparatus 10 has a series of push-button switches 24 by which a customer selects a desired tray-compartment 14, after having inserted a token, or coins, into slot 24, all of which is done in the conventional and well-known manner, and which constitutes no part of the present invention. Each push-button 24 activates a respective solenoid for unlocking the selected compartment-door 22, in order to allow access to the vended food-tray. Since the present invention has especial, intended—but not exclusive—use in senior citizen centers and independent retirement communities, it is preferred that a pre-paid token be used for operating the vending apparatus 10. As discussed hereinbelow, the novel aspects of the invention are to ensure that the food-tray is vended in an easy and safe manner as possible, so that a person may use the apparatus without undue stress and strain. The main frame 12 also has a rear, loading door 30,as seen in FIG. 4 for each vertical stack of tray-compartments, through which trays may be loaded into the compartments.

Figure 9:
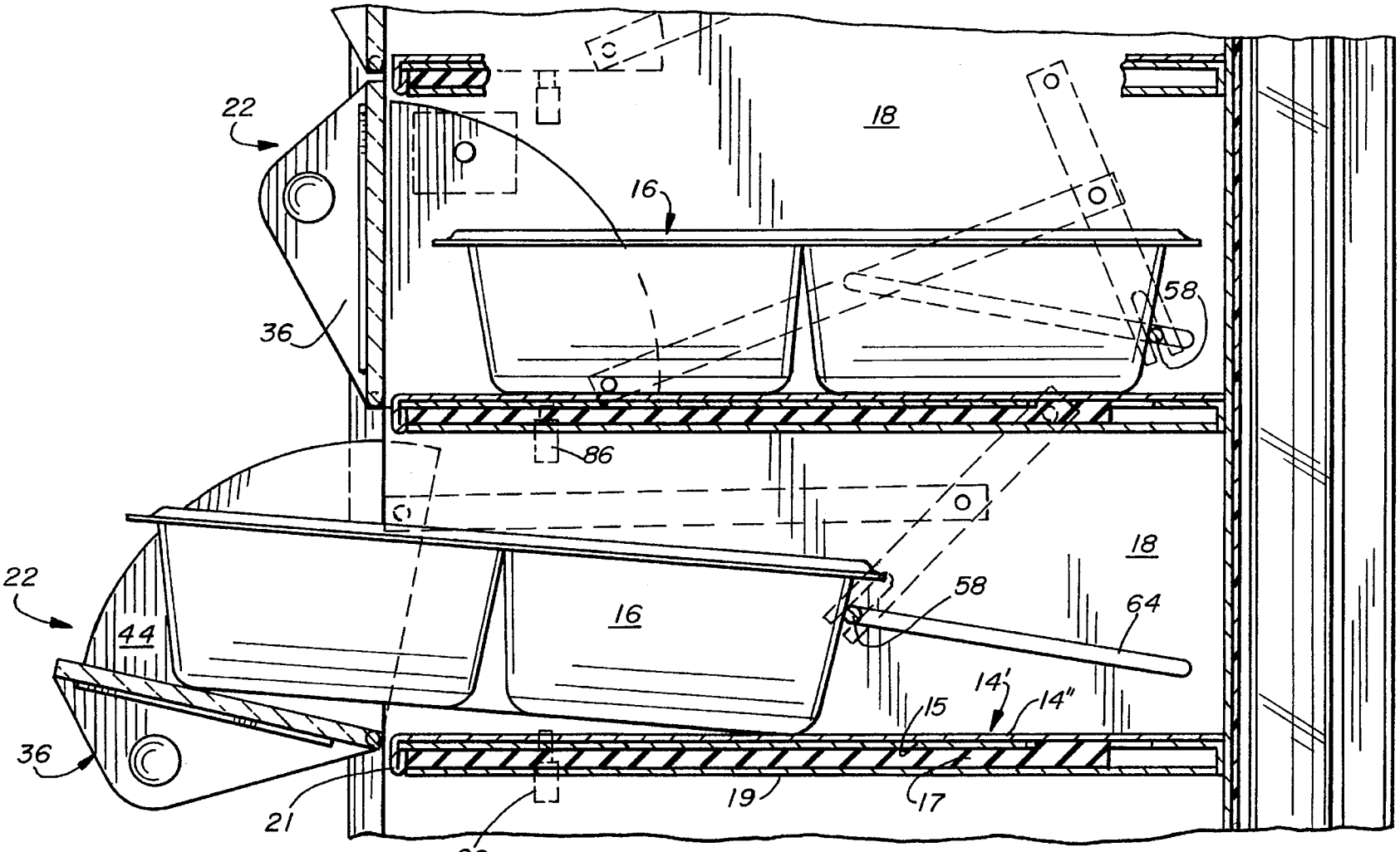
FIG. 9 is a cross-sectional view taken along line 9—9 of FIG. 10.
Figures 10, 11:
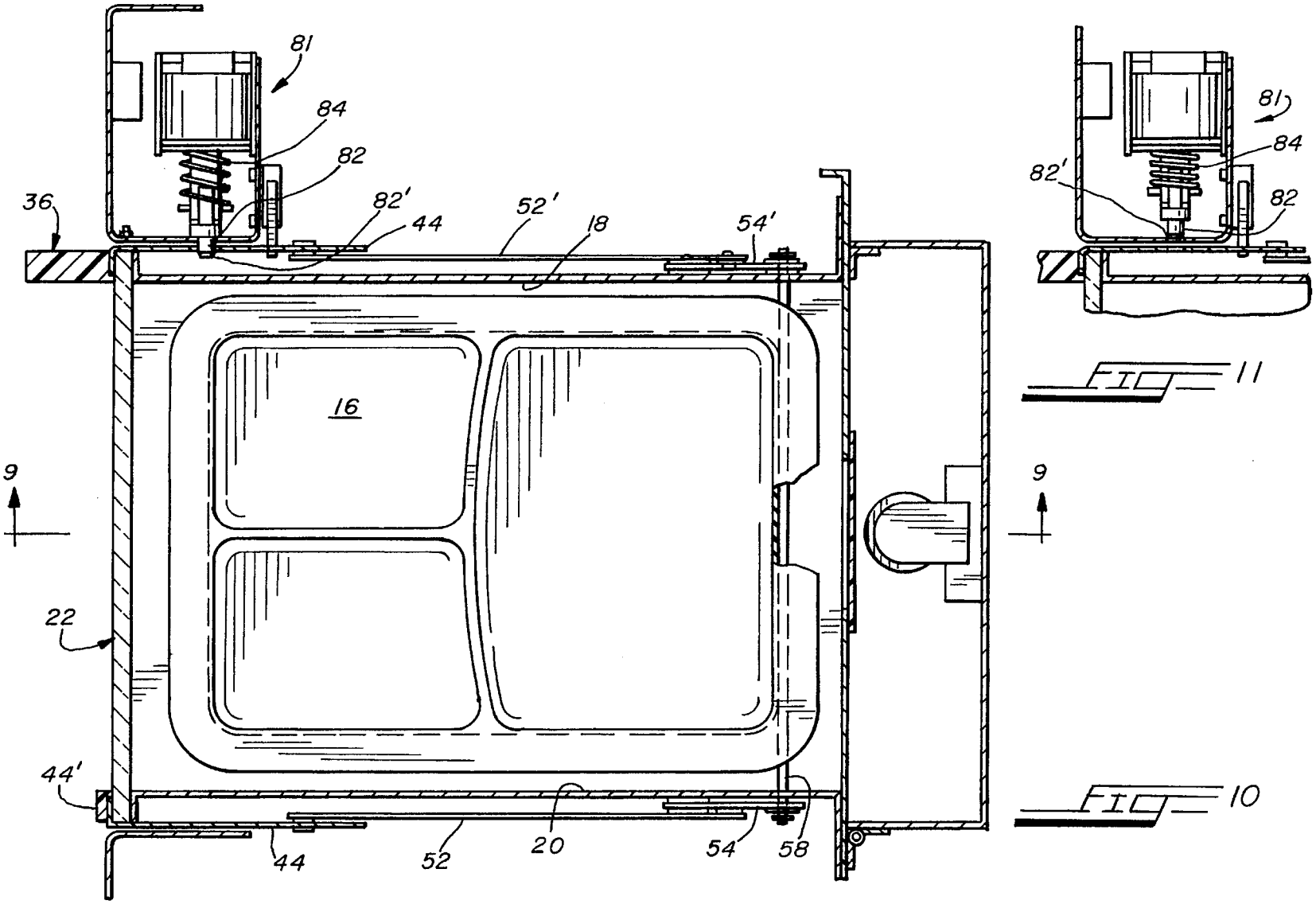
FIG. 10 is a cross-sectional view taken along line 10—10 of FIG. 7.
FIG. 11 is a detail view of a door-locking solenoid associated with each dispensing door of each compartment, the solenoid being shown in its energized state for retracting the detent rod, for allowing the selected, or vended, dispensing door to be opened by the customer.

Referring to FIGS. 9 and 10, there is shown the details of a tray-compartment 14. In addition to the front door 22 and the side walls 18 and 20, the details of the horizontal shelf 14' are shown. The horizontal shelf 14' actually consists of four separate components: A flat, top, stainless-steel sheet or floor 14", upon which actually rests the bottom support-surface of a food-tray 16, an upper heat-sink, aluminum plate 15, an electrical resistance coil-heating pad 17, and a lower heat-sink, aluminum plate 19. The heater 17 is sandwiched between the upper and lower heat-sink plates 15, 19, with these plates causing the heat generated from the heater to be distributed thereabove and therebelow, to utilize the heat generated by the heater pads 17 in the most efficient manner, to ensure that the compartments are effectively and efficiently kept at a temperature necessary to keep the food in the trays at about 140 to 150 degrees F. or higher. The heater pad 17 is affixed to the undersurface of the upper heat-sink plate 15 by means of RTV adhesive, or the like. The forward end 21 of the top, stainless-steel sheet or floor 14" is bent over to cover the front edge surfaces of the upper and lower heat-sink plates 15, 19 as well as the forward edge-surface of the heater-pad, so only stainless steel surfaces are exposed to the bottom interior of each compartment, for sanitary reasons. It is noted that the lower plate 19 forms the ceiling of the tray-compartment below it, except, of course, for the lowermost shelf. Also, the uppermost compartment has only a stainless-steel floor with no heat-sink plates. In addition, since the lower-most compartment does not have another compartment below from which might rise additional heat to heat the interior of the compartment, it is preferred that the heater-pad 17 in the floor of the lowermost compartment of each vertical stack be about 10–20% more powerful than the rest, in order to generate that amount of excess heat as compared to those heater-pads contained in the floors of the compartments above it. All of the heater-pads 17 are controlled at any one time by one thermostat whose temperature-sensing gauge is mounted at one location on an exterior wall of the main frame 12 for indirect sensing. If desired, two thermostatic controls may be provided for setting the interior temperature of the compartments, where the first-thermostatic control will keep the interior temperature of all of the compartments at a maximum temperature, such as for example 150 degrees, and where the second thermostatic control will keep the interior temperature of all of the compartments at a minimum temperature, such as for example 140 degrees. As explained above, the lowermost compartment of each vertical stack of compartments has a more powerful heater-pad to achieve the interior temperature as those in the other, upper compartments because of heat loss to area underneath the floor of the lowermost compartment.

Figure 2:
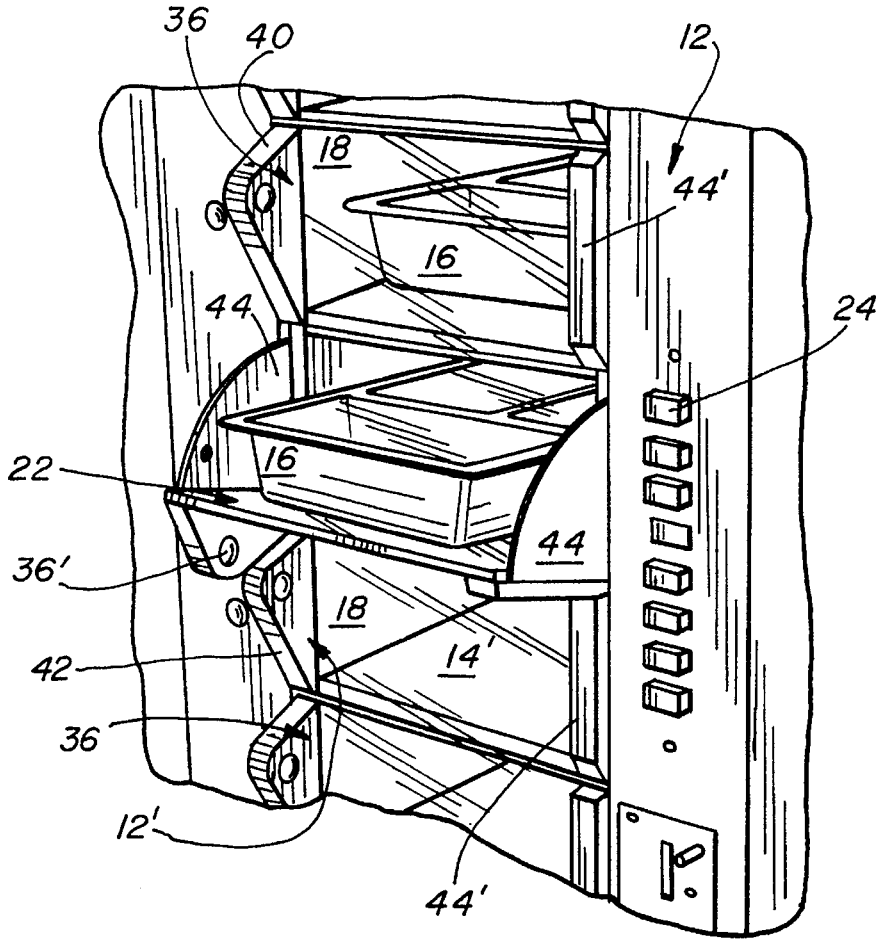
FIG. 2 is a detailed, front isometric view of the apparatus of FIG. 1., showing a selected, vended tray in its pushed-put, protruding, vended position.

Referring to FIGS. 2, 5, 6, 7 and 9, each door 22 is pivotally mounted to the main frame 12 by means of pivot rod 27, and is comprised of a front, transparent panel-section 34 through which the food-tray in the compartment may be viewed, and by which a customer may be aided in choosing his vended food-tray. At one vertical edge-surface of the panel-section 34, there is provided a triangular-shaped door-opening handle 36 by which the customer may pivot open the selected door, after the respective solenoid associated with the selected compartment has been energized, as described hereinbelow. The handle 36 has a pair of indentation recesses 36', 36" (see FIGS. 5–8), with the indentation 36' being formed in the interior surface of the handle, while the indentation 36" is formed in the exterior surface of the handle. The two indentations 36', 36" are in linear alignment, and serve as finger-grips by which the customer may grip the door and pull it down to its open position, as seen in FIGS. 1 and 2. Each of the handles 36 extends from the same vertical edge of its door as the other handles, so that the plurality of handles 36 are arranged one on top of another. Each handle 36 forms an upper, canted flat surface 40, and a lower, canted flat surface 42. The degree to which each door may be opened may be limited by the contact of its lower, canted flat surface 42 flush against the upper, canted flat surface 40 of the handle below it, although according to the preferred form of the invention, as set forth hereinbelow, there is provided a linkage mechanism for each compartment that limits the amount to which the door may be opened. Each door may be opened to a maximum position that is not horizontal, but rather forms an acute angle, such as 10 degrees, with respect to the horizontal, in the manner seen in FIG. 2. The reason for this is to prevent the accidental falling off of the vended tray from the compartment onto the floor or onto the person.

Figure 6:
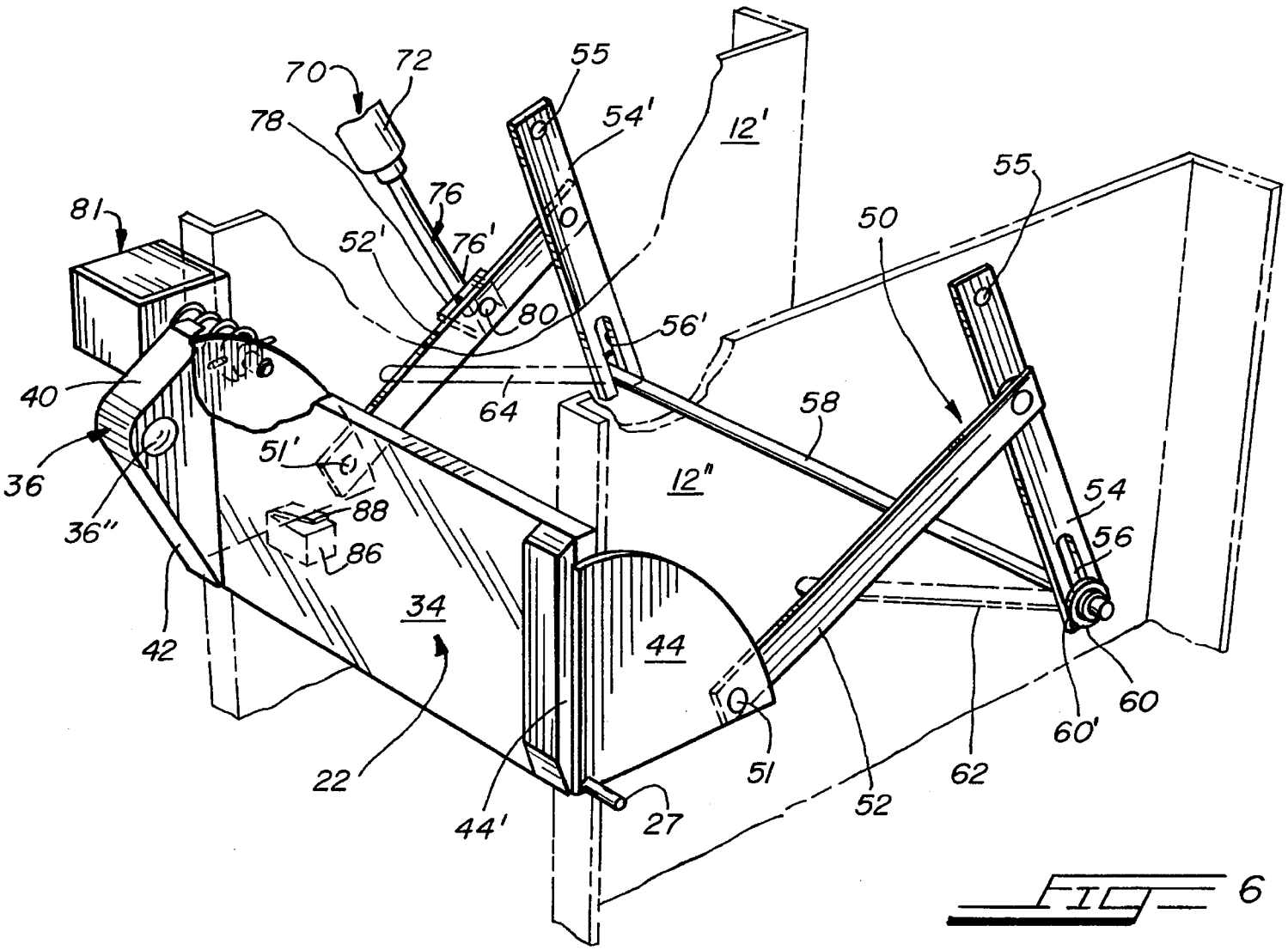
FIG. 6 is an isometric view showing a compartment of the apparatus of the invention, there being seen the push-linkage mechanism for pushing out the vended tray and the self-return piston-cylinder arrangement for automatically closing an opened door of a vended compartment after the vended tray has been removed by the customer.

Each door 22 has a pair of oppositely-disposed, triangular-shaped side plates, or enlarged rearwardly-protruding side walls 44, which project rearwardly from the vertical edge-surfaces of the front, transparent panel-section 34. One side plate 44 is secured to the vertical edge-surface from which projects the handle 36 by means of the handle itself, as seen in FIG. 10, while the other side plate is secured to the opposite vertical edge-surface by means of a vertical, front,facing strengthening rib 44' extending from the front face of the front, transparent panel-section 34 adjacent the opposite vertical edge-surface, as best seen in FIG. 6, whereby the side plates pivot along with the door. Each side plate 44 has lower hole for allowing passage of the respective pivot rod 27 associated with that door. The pair of side plates are located exteriorly of the side wall 12', 12" of the main frame which forms the side walls of the tray-compartments, but interiorly of the outer wall-section 13 (FIG. 10) of the main frame 12. Coupled to the side plates 44 is a linkage mechanism 50, which linkage mechanism serves a two-fold function: It causes the food-tray to be pushed out along the floor as the door of the compartment is opened by the customer, and also loads a piston-cylinder, reclosing mechanism as the door is opened, which piston-cylinder, reclosing mechanism will automatically close the door of the compartment after the food-tray has been removed and after the customer has let go of the door.

Figure 7:
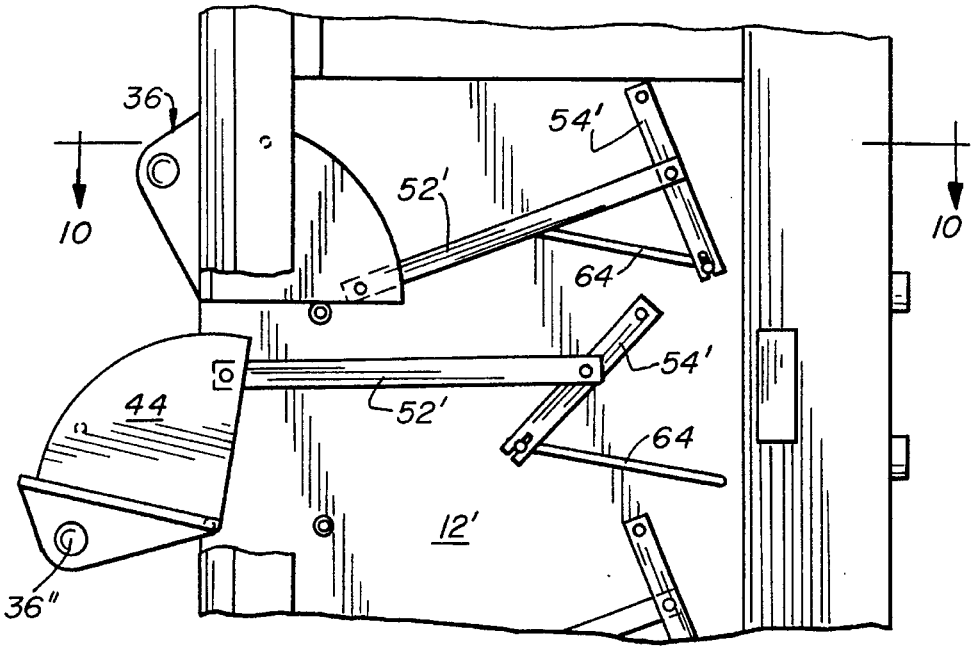
FIG. 7 is a partial, side elevational view, similar to FIG. 5, showing the relative positions of two, vertically-adjacent push-mechanisms, where one is associated with an unselected compartment with its dispensing door closed, and where one is associated with a selected, or vended, compartment with its dispensing door pivoted to its opened position for allowing removal of its tray.
Figure 8:
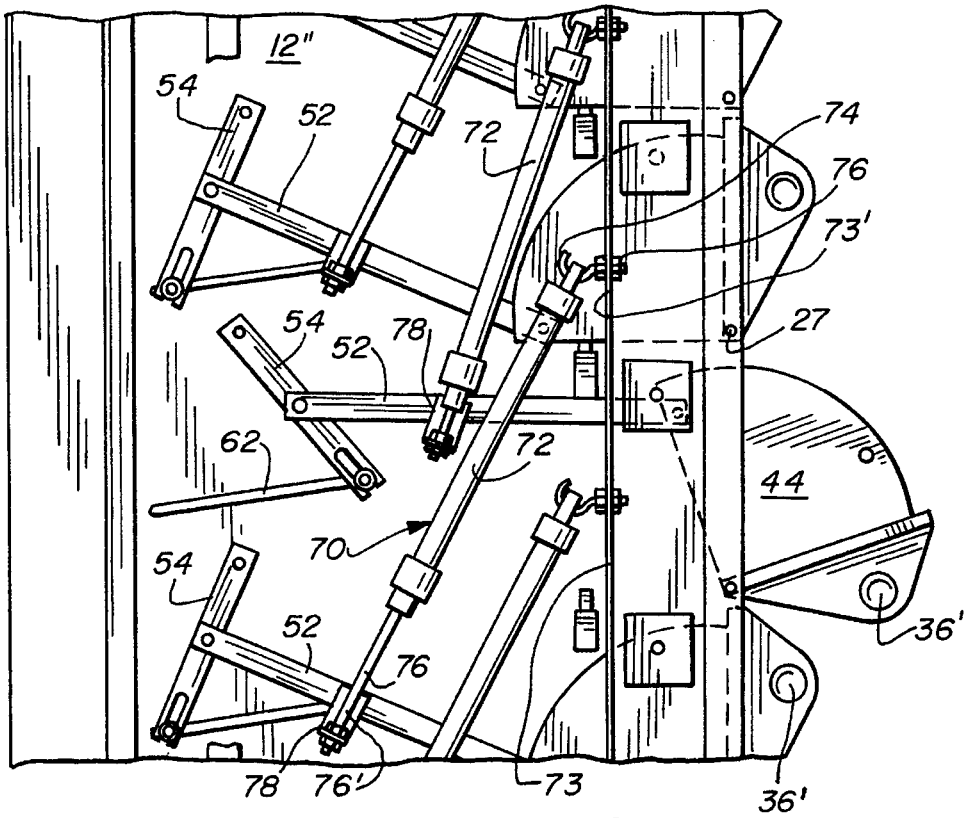
FIG. 8 is a partially broken-away, side elevational view of the opposite side of the vending apparatus as that shown in FIG. 5, where the exterior side wall has been removed to show the series of self-return piston-cylinder arrangements for automatically closing an opened door of a vended compartment after the vended tray has been removed by the customer, there being shown each such mechanism in its position with its associated door opened for dispensing a vended tray, and in its position with its associated door closed.

Referring to FIGS. 6–8, the linkage-mechanism 50 has a pair of spaced-apart, connecting rods 52, 52' pivotally connected to the pair of pivotal side plates 44. Each connecting rod 52, 52' is pivotally connected at a first end to a respective one of the side plates at an interior vertex 51, 51' of the triangularly-shaped side plate, as seen in FIG. 6, which interior vertex 51, 51' is positioned in a lower position when the door is closed. The other end of each connecting rod 52, 52' is pivotally connected to a middle portion of an intermediate, pivotal lever-arm 54, 54' as best seen in FIG. 6. Each intermediate lever-arm 54, 54' has an upper, pivotally-mounted end 55, 55' pivotally mounted to a respective side wall 18, 20, and also has a slotted lower end 56, 56' in which slides an end 60 of a push-rod 58. The ends 60 of the push-rod are retained by enlarged flanges 60'. Interiorly of the ends 60, the push-rod 58 passes through, and slides in, upwardly-sloping slots 62, 64 formed in the side walls 18, 20 of the compartment. When the door of the compartment is closed, the push-rod 58 is located in the rear interior of the tray-compartment, and at a low elevation with respect to the floor of the tray-compartment, as seen in FIGS. 6 and 9. In this lowermost position, the push-rod 58 abuts against a lower, rear surface-area of the food-tray in the tray-compartment, which food-tray, upon being inserted into the tray-compartment from the rear loading door 30, is initially positioned therein such as to ensure that its rear surface wall is placed against the push-rod. As the door of the tray-compartment is opened up by the customer after the customer has selected the vended compartment, the forward ends of the connecting rods 52, 52' are pulled forward and lifted vertically upwardly by means of the pivoted side plates 44. The connecting rods 52, 52' will, in turn, rotate the intermediate lever-arms 54, 54' to move the push-rod 58 forwardly inside the compartment with its ends guided in the slots 62, 64, thereby pushing the food-tray toward the opened door. As the door is pivoted evermore open, the push-rod is forced evermore forwardly and upward along the slots 62, 64, with the slots 56, 56' in the lower ends of the intermediate lever-arms 54, 54' providing the lost-motion connection. The striking of the ends of the push-rod against the upper ends of the slots 58 constitutes the maximum amount that the door 22 may be opened, which maximum position makes an acute angle of approximately 10 degrees with respect to the horizontal, in order to prevent the food-tray from accidentally falling out. The fact that the push-rod moves upwardly during its forward motion also helps to counteract forces tending to cause spillage of any liquid food contained in the tray, and also diminishes the horizontal force Component of the push-rod, which, by itself, reduces the effect of inertia. This upward movement of the push-rod is also advantageous in order that the food-tray is pushed at a upper portion thereof after the door has been partially opened, since a force must be provided that is great enough to push the food-tray up an upwardly-sloping inclined surface. It is preferred that the angle of slope of each slot 62, 64 be the same as the angle that the door makes with the horizontal when in its maximum open position, so that the vertical and horizontal force components of the push-rod 58 are more advantageously distributed to match the inclined plane of the door upon which the tray is being pushed up, whereby the food-tray is pushed out smoothly, without jerking movement that might be caused by dynamic friction between the bottom of the tray and the surface of the door.

Operatively associated with each linkage 50 of each tray-compartment is a self-closing mechanism 70 that automatically closes the door of the compartment with which it is associated, after the customer has released the door. The self-closing mechanism 70 is best seen in FIGS. 6 and 8, and consists of a spring-loaded air cylinder 72 having an upper end 72' pivotally attached to an interior or rear-facing surface 73' of the front wall 73 of the main frame 12, which attachment is achieved by means of a hook-mount assembly 74 fixedly mounted to the front wall 73. The upper end of the air cylinder 72 has an eye for receiving the hook-end of the hook-mount assembly 74, whereby the air cylinder is permitted a limited degree of pivotal movement about the hook-mount assembly 74. Slidably mounted in the air cylinder is a piston-member 76, which piston-member has a lower end 76' connected to a mid-section of the connecting rod 52'. This lower end 76' is attached to the connecting rod 52' by means of right-angle mounting plate 78. The right-angle mounting plate 78 has a first, horizontal section to which the lower end 76' of the piston-member 76 is fixedly secured, and a second, vertical section which is directly and pivotally mounted to the mid-section of the connecting rod 52' by means of a pivot rod 80. Whenever a door 22 is opened by a customer for vending a food-tray, such opening causes the rotation of the side plates 44 associated therewith, which side plates 44 thereby lift up the connecting rods 52, 52', which in turn, causes the piston-member 76 to slide upwardly within its air cylinder, thereby compressing the internal compression spring. When the door 22 is released by the customer, the piston-member 76 slides downwardly within the cylinder 72, which pushes the connecting rod 52' down, to thereby rotate the side plates 44 in the opposite direction, to close the door 22. The air cylinder arrangement also acts as an damper during the opening of the door in that the sliding piston in the cylinder compresses the air therein, thereby limiting how fast and easy one may open the door 22. This ensures that the food-tray is not pushed out too fast or in a jerky fashion, but rather in a relatively slow and even pace, helping to prevent the tray from falling out, and helping to prevent spillage of food as the tray is pushed out.

As mentioned previously, each door is locked, or latched, by means of an associated solenoid 81, as best seen in FIGS. 6, 8, 10 and 11. Each solenoid is mounted by the exterior side frame of the main frame 12, and has an extensible and retractable latching pin 82, which is spring-biassed outwardly by compression spring 84. In the unactuated state of the solenoid 81, the latching pin 82 is normally biassed outwardly and through retaining hole 82' formed in a portion of the side plate 44 on the side of the door adjacent to the main frame's interior side wall 12', as best seen in FIG. 6. When a customer selects a desired tray-compartment, the associated solenoid for that compartment is actuated, to thus retract the latching pin 82 clear of the hole 82', in order to release the door for subsequent opening by the customer. Operatively associated with each compartment is a micro-switch 86. Each micro-switch 86 is mounted directly underneath the side plate 44 with which the associated solenoid is connected. Each micro-switch has a spring-biassed, actuating lever 88, as best seen in FIG. 6, which lever is acted upon by the bottom surface of the rotating side plate 44 with which it is associated. When the door of the compartment is in closed position, the lever 88 of the micro-switch 86 is pushed down by the bottom surface of the side plate, as seen in FIG. 6, to thus close an electrical circuit (FIG. 12), whereby it is possible to supply current to any of the solenoids 81 of the apparatus, so that once a customer selects a compartment, power may be supplied to the solenoid associated with the vended tray for allowing opening of the door of the selected compartment. As soon as the selected door is opened by the customer, the actuating lever 88 is allowed to be lifted up, which thereby opens the electrical circuitry providing power to the solenoid 81. By opening this circuit, all of the solenoids 81 of the apparatus are now disabled, which prevents any other door of any other compartment from being opened until the selected, opened door is again returned to its closed position. As the selected door 22 is opened, the latching pin 82 of the selected compartment's solenoid rides along the outer surface of its associated side plate 44, as the side plate is rotated first in the counter-clockwise direction, when viewing FIG. 6, as the door 22 is being opened, and then in the clockwise direction as the door 22 is allowed to close automatically. The arcuate profile of the side plate 44 ensures that there is a surface against which the latching pin will abut for all movements and positions of the side plate 44. When the door is back in its fully-closed position, the latching pin is again forced through the retaining holes 82' of the side plate 44 with which it is associated, to thus lock, or latch, the compartment-door until it is again selected by a customer. The full-closing of the door also depresses the actuating lever 88 of the micro-switch 86 associated with that compartment, to again enable any of the solenoid switches for subsequent actuation of one of them as determined by a customer.

Figure 12:
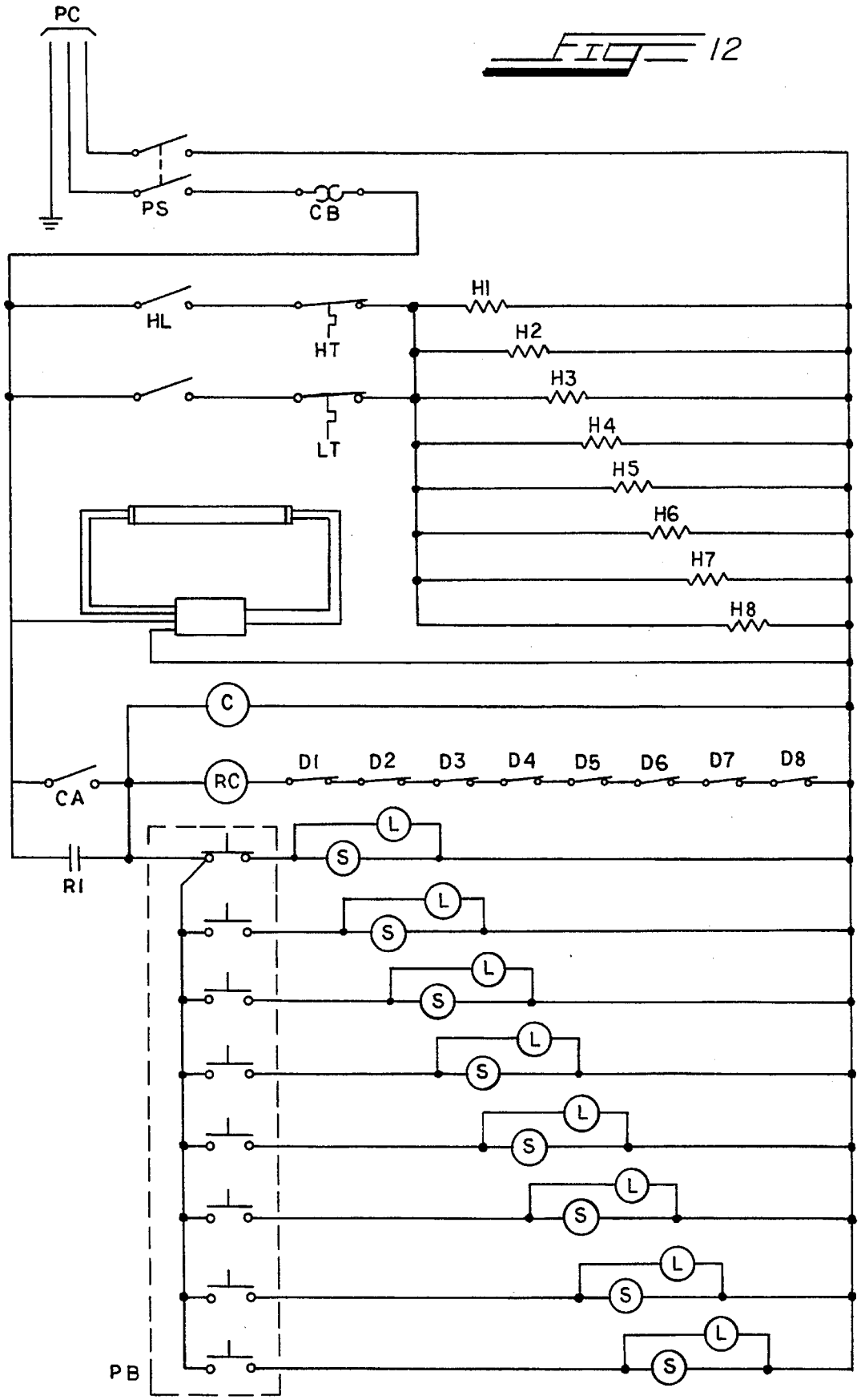
FIG. 12 is an electrical schematic of the electrical circuitry for controlling the vending apparatus of the invention.

Referring now to FIG. 12, the electrical schematic for controlling the operation of the apparatus 10 is shown. Elements D1–D8 indicate the micro-switches 86, which are arranged in series, so that if anyone of them becomes open, power to all of the solenoids 80 is cut off, which solenoids are indicated by the symbol "S" in the schematic. After insertion of the requisite amount of coins or token, depression of a button "PB" selects the desired tray-compartment, and energizes the solenoid associated with that compartment until the micro-switch thereof is opened, as fully described above. A lamp "L" on the front of the apparatus indicates which compartment has been selected. The heater pads 17 are indicated by the symbol H1–H8, and controlled by either of two thermostats HT or LT, the first one maintaining the temperature of the compartments at about 150 degrees F., while the second one maintains the temperature of the compartments at about 140 degrees. Instead of the electrical schematic of FIG. 12, the apparatus 10 may be controlled by microprocessor-based system with dedicated software.

It is noted that the structure herein disclosed and claimed has use and application to the dispensing of other items besides food-trays, and also to apparatuses other than vending machines. For example, the mechanical linkage for pushing out or ejecting the food-tray may be used in any apparatus that has a door, which, when opened, allows access to an item in the interior of the apparatus.

While a specific embodiment of the invention has been shown and described, it is to be understood that numerous changes and modifications may be made therein without departing from the scope, spirit and intent of the invention as set forth in the appended claims.

What we claim is:

1. In an apparatus for dispensing food-trays, which apparatus comprises a main frame, and a plurality of tray-compartments in said main frame for storing a plurality of food-trays, each of said plurality of tray-compartments comprising side walls, a floor upon which rests a food-tray, and a ceiling, wherein the improvement comprises:

each of said plurality of tray-compartments comprising heating means mounted in said floor for heating the interior of the respective tray-compartment for maintaining the food in the food-tray stored in the respective tray-compartment at a hot temperature;

said plurality of tray-compartments being stacked vertically one above the other, and comprise a lowermost tray-compartment; said heating means of said lowermost tray-compartment generating more heat than the heating means of the rest of said plurality of tray-compartments, whereby the temperature of the interior of said lowermost tray-compartment is maintained approximately at the same temperature as the interior of the other tray-compartments.

2. The apparatus according to claim 1, wherein said floor of each of said plurality of tray-compartments comprise an upper shelf upon which rests a food-tray and a heat-sink layer positioned below said upper shelf; said heating means being positioned below said heat-sink layer.

3. The apparatus according to claim 2, wherein said plurality of tray-compartments are stacked vertically one above the other; said floor of at least most of said plurality of tray-compartments mounting one said ceiling of the tray-compartment positioned directly, therebelow, said ceiling mounted directly to said floor and said upper heat-sink layer of said floor sandwiching therebetween said heating means operatively associated with said floor.

4. The apparatus according to claim 2, wherein said upper heat-sink layer is made of metal, and said heating means comprising electrical resistance coils.

5. The apparatus according to claim 3, wherein said Upper heat-sink layer is made of metal, and said heating means comprises electrical resistance coils; each said ceiling of most of said plurality of tray-compartments being made of heat-conducting material, so that the heat in the interior of each tray-compartment will be conducted upwardly to the interior of the tray-compartment located directly thereabove.

6. In an apparatus for dispensing food-trays, which apparatus comprises a main frame, and a plurality of tray-compartments in said main frame for storing a plurality of food-trays, each of said plurality of tray-compartments comprising side walls, a floor upon which rests a food-tray, and a ceiling, wherein the improvement comprises:

each of said plurality of tray-compartments comprising heating means mounted in said floor for heating the interior of the respective tray-compartment for maintaining the food in the food-tray stored in the respective tray-compartment at a hot temperature;

each of said plurality of tray-compartments comprising a front, pivotally-mounted door, and a linkage operatively coupled to said door and actuated by the movement of said door, and a push-member mounted in the interior of the tray-compartment and operatively connected to said linkage, said push-member being moved forwardly in the interior of the tray-compartment to push a food-tray positioned in the interior of the tray-compartment toward the door.

7. The apparatus according to claim 6, wherein said plurality of tray-compartments are stacked vertically one above the other, and comprise a lowermost tray-compartment; said heating means of said lowermost tray-compartment generating more heat than the heating means of the rest of said plurality of tray-compartments, whereby the temperature of the interior of said lowermost tray-compartment is maintained approximately at the same temperature as the interior of the other tray-compartments.

8. The apparatus according to claim 1, wherein each of said plurality of tray-compartments comprises a front, pivotally-mounted door, and means for preventing said door from being opened to a position that is substantially coplanar with said floor of said tray-compartment, whereby, in its fully-opened position, said door makes an acute angle with respect to the horizontal, in order to prevent a food-tray from falling out.

9. The apparatus according to claim 8, wherein each said door comprises at least one forwardly-projecting handle section for use in opening the door; said handle section comprising an upper surface and a lower surface; said handle sections of all of said doors of said plurality of tray-compartments being mounted vertically above one another in vertical alignment; said means for preventing said door from being opened to a position that is substantially coplanar with said floor of said tray-compartment being constituted by said upper and lower surfaces of said handle section, whereby when said door is opened to its maximum position, said lower surface thereof strikes against an upper surface of a handle section of the door positioned directly therebelow.

10. The apparatus according to claim 8, wherein said means for preventing said door from being opened to a position that is substantially coplanar with said floor of said tray-compartment comprises a linkage operatively coupled to said door and actuated by the movement of said door, said linkage limiting the pivotal movement of said door to a maximum position.

11. The apparatus, according to claim 10, wherein said linkage comprises at least one lever having a first end section pivotally connected to a portion of said door, and a second end section; at least one said side wall of said tray-compartment having a slot formed therein with a forward end, said second end section of said at least one lever being slidable in said slot until striking against said forward end of said slot, whereby further opening of the door is prevented.

12. In an apparatus for dispensing food-trays, which apparatus comprises a main frame, and a plurality of tray-compartments in said main frame for storing a plurality of food-trays, each of said plurality of tray-compartments comprising side walls, a floor upon which rests a food-tray, and a ceiling, wherein the improvement comprises:

each of said plurality of tray-compartments comprising a front, pivotally-mounted door, and means for preventing said door from being opened to a position that is substantially coplanar with said floor of said tray-compartment, whereby, in its fully-opened position, said door makes an acute angle with respect to the horizontal, in order to prevent a food-tray from falling out;

said means for preventing said door from being opened to a position that is substantially coplanar with said floor of said tray-compartment comprising a linkage operatively coupled to said door and actuated by the movement of said door, said linkage limiting the pivotal movement of said door to a maximum position;

said linkage comprising at least one lever having a first end section pivotally connected to a portion of said door, and a second end section; at least one said side wall of said tray-compartment having a slot formed therein with a forward end, said second end section of said at least one lever being slidable in said slot until striking against said forward end of said slot, whereby further opening of the door is prevented.

13. The apparatus according to claim 12, wherein said linkage comprises a connecting lever, and a push-rod member at least partially mounted in the interior of the tray-compartment and having an end section and being operatively connected to said connecting lever, said push-rod being moved forwardly in the interior of the tray-compartment to push a food-tray positioned in the interior of the tray-compartment toward the door; said second end section of said at least one lever being said end section of said push-rod.

14. The apparatus according to claim 13, wherein said slot in at least one side wall is an at least partially upwardly sloping linear slot making an acute angle with respect to the horizontal, whereby, as said end section of said push-rod is slid in said slot, it is raised vertically for at least some of the forward movement of said push-rod in said slot, in order that the push-rod contact the rear wall of the food-tray being pushed out of the tray-compartment at higher elevations of the rear wall as the front wall of the food-tray protrudes more outwardly from the tray-compartment.

15. The apparatus according to claim 1, wherein each of said plurality of tray-compartments comprises a front, pivotally-mounted door, locking means for locking said door in its closed position, and switch means for disabling all of said locking means of all of said tray-compartments in response to the respective said door with which it is associated being opened; said switch means comprising a switch directly controlled by the movement of said door into its open position and into its completely closed position, whereby upon each said switch means being opened in response to the opening of the door with which it is associated, power to said locking means is terminated, whereby any door other than the one being opened is prevented from being opened.

16. The apparatus according to claim 15, wherein each said door comprises a first and a second side wall surface projecting rearwardly and exteriorly of said side walls of said tray-compartment, said first side wall surface projecting exteriorly of one said side wall of said tray-compartment, and said second side wall surface projecting exteriorly of the other said side wall of said tray-compartment; said locking means being directly operatively associated with at least one of said first and second side wall surfaces, and said switch means being directly operatively associated with at least one of said first and second side wall surfaces.

17. In an apparatus for dispensing containers, trays, and the like, which apparatus comprises a main frame, and at least one compartment in said main frame for storing at least one container or tray, said at least one compartment comprising side walls, and a floor upon which rests a food-tray, wherein the improvement comprises:

a front, pivotally-mounted door, and means for preventing said door from being opened to a position that is substantially coplanar with said floor of said compartment, whereby, in its fully-opened position, said door makes an acute angle with respect to the horizontal, in order to prevent a container or tray from falling out; and a plurality of compartments stacked vertically one above the other, each said compartment having a said floor and door; each said door comprising at least one forwardly-projecting handle section for use in opening the door, said handle section comprising an upper surface and a lower surface; said handle sections of all of said doors of said plurality of compartments being mounted vertically above one another in vertical alignment; said means for preventing said door from being opened to a position that is substantially coplanar with said floor of said compartment being constituted by said upper and lower surfaces of said handle section, whereby when said door is opened to its maximum position, said lower surface thereof strikes against an upper surface of a handle section of the door positioned directly therebelow.

18. The apparatus according to claim 17, wherein said means for preventing said door from being opened to a position that is substantially coplanar with said floor of said compartment comprises a linkage operatively coupled to said door and actuated by the movement of said door, said linkage limiting the pivotal movement of said door to a maximum position.

19. In an apparatus for dispensing containers, trays, and the like, which apparatus comprises a main frame, and at least one compartment in said main frame for storing at least one container or tray, said at least one compartment comprising side walls, and a floor upon which rests a food-tray, wherein the improvement comprises:

a front, pivotally-mounted door, and means for preventing said door from being opened to a position that is substantially coplanar with said floor of said compartment, whereby, in its fully-opened position, said door makes an acute angle with respect to the horizontal, in order to prevent a container or tray from falling out;

said means for preventing said door from being opened to a position that is substantially coplanar with said floor of said compartment comprises a linkage operatively coupled to said door and actuated by the movement of said door, said linkage limiting the pivotal movement of said door to a maximum position;

said linkage comprising at least one lever having a first end section pivotally connected to a portion of said door, and a second end section; at least one said side wall of said compartment having a slot formed therein with a forward end, said second end section of said at least one lever being slidable in said slot until striking against said forward end of said slot, whereby further opening of the door is prevented.

20. The apparatus according to claim 19, wherein said linkage comprises a connecting lever, and a push-rod member at least partially mounted in the interior of the compartment and having an end section and being operatively connected to said connecting lever, said push-rod being moved forwardly in the interior of the compartment to push a container or tray positioned in the interior of the compartment toward the door; said second end section of said at least one lever being said end section of said push-rod.

21. The apparatus according to claim 20, wherein said slot in at least one side wall is an at least partially upwardly sloping linear slot making an acute angle with respect to the horizontal, whereby, as said end section of said push-rod is slid in said slot, it is raised vertically for at least some of the forward movement of said push-rod in said slot, in order that the push-rod contact the rear wall of the container or tray being pushed out of the compartment at higher elevations of the rear wall as the front wall of the container or tray protrudes more outwardly from the compartment.

22. In a dispensing apparatus, which apparatus comprises a main frame, and at least one compartment in said main frame for storing an item to be dispensed, said at least one compartment comprising side walls, and a door which when opened allows access to the interior of the compartment, wherein the improvement comprises:

ejecting means for causing the item to be dispensed in said compartment to be at least partially ejected from the interior of said compartment when said door is being opened; and a mechanical linkage operatively coupled between said door and said ejecting means, said mechanical linkage being directly actuated by the movement of said door into its open position;

said mechanical linkage moving said ejecting means to at least partially eject an item to be dispensed through said door as said door is being opened;

said mechanical linkage comprising at least one lever having a first end section pivotally connected to a portion of said door, and a second end section; at least one said side wall of said compartment having a slot formed therein with a forward end, said second end section being operatively connected to said ejecting means for moving said ejecting means; and said ejecting means comprising a push rod, a portion of said push-rod being slidable in said slot.

23. The dispensing apparatus according to claim 22, wherein each said slot of said side walls makes an acute angle with respect to the horizontal, whereby, as said end section of said push-rod is slid in said slot, it is raised vertically for at least some of the forward movement of said push-rod in said slot, in order that the push-rod contact the rear of the item being dispensed and being pushed out of the compartment at higher elevations of the rear thereof as the front of the item being dispensed protrudes more outwardly from the compartment.

24. The dispensing apparatus according to claim 22, further comprising a door-self-closing mechanism for automatically closing the door after it has been opened; said door-self-closing mechanism being operatively associated with said mechanical linkage and set to return the door to its closed position in response to the opening of the door.

25. The dispensing apparatus according to claim 24, wherein said door-self-closing mechanism comprises a piston-cylinder arrangement having a first end connected to the main frame, and a second end pivotally connected to said mechanical linkage; said mechanical linkage moving the piston into the cylinder during the opening of said door of said compartment in order to load said piston-cylinder arrangement, the piston being forced outwardly of the cylinder after the door has been released, which piston moves said mechanical linkage in the opposite direction to thus close said door, said piston-cylinder arrangement also acting as a damper when said door is being opened.

26. The dispensing apparatus according to claim 22, further comprising limit means for limiting the amount that said door may be opened, said limit means preventing said door from being opened to a completely horizontal position, whereby said item being dispensed is prevented from being pushed onto the floor by said ejecting means.

27. A method of dispensing an item from a compartment having a door allowing access to the interior of the compartment, comprising:

(a) manually opening the door of the compartment to access the item in the interior of the compartment;

(b) in direct response to the performing of said step (a), at least partially ejecting the item in the interior of the compartment;

(c) said step (b) being performed automatically as said step (a) is being performed by mechanical couplement of the door with an ejector of the item;

(d) said step (c) receiving its driving force directly from the manual opening of the door of said step (a);

said step (a) comprising limiting the degree to which the door may be opened such that it is makes an acute angle with respect to the horizontal, whereby the ejected item will not fall completely out of the compartment.

28. The method according to claim 27, further comprising:

(e) automatically returning the opened door to its closed position after the door has been released;

(f) said step (e) receiving its driving force also directly from the manual opening of the door of said step (a).

29. The method according to claim 28, further comprising damping the opening of said door so that the door is opened slowly and safely.

30. The method according to claim 27, wherein said step (b) comprises pushing out the item by means of a push-member, said step of pushing comprising initially contacting a lower rear surface portion of the item, and sliding the push-rod higher along the rear surface portion of the item as the push-rod is moved from the rear of the compartment toward the front of the compartment where the door is located, whereby when the item is finally pushed out, the push-rod contacts the rear surface of the item at an elevation on the rear surface that is higher than when initially connecting the lower rear surface portion of the item.

31. A method of dispensing an item from a compartment having a door allowing access to the interior of the compartment, comprising:

(a) manually opening the door of the compartment to access the item in the interior of the compartment;

(b) in direct response to the performing of said step (a), at least partially ejecting the item in the interior of the compartment;

(c) said step (b) being performed automatically as said step (a) is being performed by mechanical couplement of the door with an ejector of the item;

(d) said step (c) receiving its driving force directly from the manual opening of the door of said step (a);

said step (b) comprising pushing out the item by means of a push-member, said step of pushing comprising initially contacting a lower rear surface portion of the item, and sliding the push-rod higher along the rear surface portion of the item as the push-rod is moved from the rear of the compartment toward the front of the compartment where the door is located, whereby when the item is finally pushed out, the push-rod contacts the rear surface of the item at an elevation on the rear surface that is higher than when initially contacting the lower rear surface portion of the item.

32. The method according to claim 31, further comprising:

(e) automatically returning the opened door to its closed position after the door has been released;

(f) said step (e) receiving its driving force also directly from the manual opening of the door of said step (a);

said step (e) causing the push-rod to return to its initial position for pushing out another item placed in the compartment.

33. The method according to claim 27, wherein said step (b) comprises pushing out the item by means of a push-member, said step of pushing comprising initially contacting a lower rear surface portion of the item, and sliding the push-rod higher along the rear surface portion of the item as the push-rod is moved from the rear of the compartment toward the front of the compartment where the door is located, whereby when the item is finally pushed out, the push-rod contacts the rear surface of the item at an elevation on the rear surface that is higher than when initially contacting the lower rear surface portion of the item;

said step of pushing out the item partially ejecting the item so that a front section of the item rests on the upwardly-sloping, opened door and a rear section rests on the floor in the interior of the compartment.

34. The method according to claim 33, further comprising: biasing the door into its closed position while it is being opened, whereby the tray partially resting on the open door is prevented from falling out of the compartment.

35. The method according to claim 27, further comprising: biasing the door into its closed position while it is being opened, whereby the tray is prevented from falling out of the compartment.

36. The method according to claim 27, further comprising: biasing the door into its closed position while it is being opened, whereby the tray partially resting on the open door is prevented from falling out of the compartment.

37. The apparatus according to claim 6, wherein said linkage comprises a pair of first members positioned adjacent opposite, lateral side walls of said tray-compartment, each said first member having a first end pivotally connected to a portion of said door, and a second end.

38. The apparatus according to claim 37, wherein wherein said linkage further comprises a pair of second members positioned adjacent opposite, lateral side walls of said tray-compartment; each said second member having a first end pivotally connected to a portion of said main frame for pivotal movement in a vertical plane, each said second end of said pair of first members being pivotally connected to one said second member;

each said second member comprising a slotted second end; said push-member having a pair of ends mounted for sliding movement in said slotted ends of said second members; each said side wall of said tray-compartment comprising a slot in which slides a portion of said push-member, whereby, when said door of said tray-compartment is opened, said first members are moved forwardly therewith to pivot said second members, which causes said push-rod to slide forwardly in said slots in said side walls, thereby pushing out the food-tray from the tray-compartment and partially through the opened door.

39. The apparatus according to claim 38, wherein each said slot in a said side wall has a forward end against which strikes said push-member when said door is opened to its maximum position, said forward end of said slot preventing said door from being opened to a position that is substantially coplanar with said floor of said tray-compartment, whereby in its fully-opened position, said door makes an acute angle with respect to the horizontal, in order to prevent a food-tray from falling out.

40. In an apparatus for dispensing food-trays, which apparatus comprises a main frame, and a plurality of tray-compartments in said main frame for storing a plurality of food-trays, each of said plurality of tray-compartments comprising side walls, a floor upon which rests a food-tray, and a ceiling, wherein the improvement comprises:

each of said plurality of tray-compartments comprising a front, pivotally-mounted door, and means for preventing said door from being opened to a position that is substantially coplanar with said floor of said tray-compartment, whereby, in its fully-opened position, said door makes an acute angle with respect to the horizontal, in order to prevent a food-tray from falling out;

each said door comprising at least one forwardly-projecting handle section for use in opening the door; said handle section comprising an upper surface and a lower surface; said handle sections of all of said doors of said plurality of tray-compartments being mounted vertically above one another in vertical alignment; said means for preventing said door from being opened to a position that is substantially coplanar with said floor of said tray-compartment being constituted by said upper and lower surfaces of said handle section, whereby when said door is opened to its maximum position, said lower surface thereof strikes against an upper surface of a handle section of the door positioned directly therebelow.

41. In an apparatus for dispensing food-trays, which apparatus comprises a main frame, and a plurality of in said main frame for storing a plurality of food-trays, each of said plurality of tray-compartments comprising side walls, a floor upon which rests a food-tray, and a ceiling, wherein the improvement comprises:

each of said plurality of tray-compartments comprising a front, pivotally-mounted door, locking means for locking said door in its closed position, and switch means for disabling all of said locking means of all of said tray-compartments in response to the respective said door with which it is associated being opened; said switch means comprising a switch directly controlled by the movement of said-door into its open position and into its completely closed position, whereby upon each said switch means being opened in response to the opening of the door with which it is associated, power to said locking means is terminated, whereby any door other than the one being opened is prevented from being opened.

42. The apparatus according to claim 41, wherein each said door comprises a first and a second side wall surface projecting exteriorly of said side walls of said tray-compartment, said first side wall surface projecting exteriorly of one said side wall of said tray-compartment, and said second side wall surface projecting exteriorly of the other said side wall of said tray-compartment; said locking means being operatively associated with at least one of said first and second side wall surfaces, and said switch means being operatively associated with at least one of said first and second side wall surfaces.

43. In a dispensing apparatus, which apparatus comprises a main frame, and at least one compartment in said main frame for storing an item to be dispensed, said at least one compartment comprising side walls, and a door which when opened allows access to the interior of the compartment, wherein the improvement comprises:

ejecting means for causing the item to be dispensed in said compartment to be at least partially ejected from the interior of said compartment when said door is being opened; and a mechanical linkage operatively coupled between said door and said ejecting means, said mechanical linkage being directly actuated by the movement of said door into its open position;

said mechanical linkage moving said ejecting means to at least partially eject an item to be dispensed through said door as said door is being opened;

said mechanical linkage comprising a pair of first members positioned adjacent opposite, lateral side walls of said compartment, each said first member having a first end pivotally connected to a portion of said door, and a second end; and a pair of second members positioned adjacent opposite, lateral side walls of said compartment, each said second member having a first end pivotally connected to a portion of said main frame for pivotal movement in a vertical plane, each said second end of said pair of first members being pivotally connected to one said second member; each said second member comprising a slotted second end; said ejecting means comprising a push-member having a pair of ends mounted for sliding movement in said slotted ends of said second members; each said side wall of said compartment comprising a slot in which slides a portion of said push-member.

44. In a dispensing apparatus, which apparatus comprises a main frame, and at least one compartment in said main frame for storing an item to be dispensed, said at least one compartment comprising side walls, and a door which when opened allows access to the interior of the compartment, wherein the improvement comprises:

ejecting means for causing the item to be dispensed in said compartment to be at least partially ejected from the interior of said compartment when said door is being opened; and a mechanical linkage operatively coupled between said door and said ejecting means, said mechanical linkage being directly actuated by the movement of said door into its open position;

said mechanical linkage moving said ejecting means to at least partially eject an item to be dispensed through said door as said door is being opened;

a door-self-closing mechanism for automatically closing the door after it has been opened; said door-self-closing mechanism being operatively associated with said mechanical linkage and set to return the door to its closed position in response to the opening of the door;

said door-self-closing mechanism comprising a piston-cylinder arrangement having a first end connected to the main frame, and a second end pivotally connected to said mechanical linkage; said mechanical linkage moving the piston into the cylinder during the opening of said door of said compartment in order to load said piston-cylinder arrangement, the piston being forced outwardly of the cylinder after the door has been released, which piston moves said mechanical linkage in the opposite direction to thus close said door, said piston-cylinder arrangement also acting as a damper when said door is being opened.

45. In a dispensing apparatus, which apparatus comprises a main frame, and at least one compartment in said main frame for storing an item to be dispensed, said at least one compartment comprising side walls, and a door which when opened allows access to the interior of the compartment, wherein the improvement comprises:

ejecting means for causing the item to be dispensed in said compartment to be at least partially ejected from the interior of said compartment when said door is being opened; and a mechanical linkage operatively coupled between said door and said ejecting means, said mechanical linkage being directly actuated by the movement of said door into its open position;

said mechanical linkage moving said ejecting means to at least partially eject an item to be dispensed through said door as said door is being opened;

limit means for limiting the amount that said door may be opened, said limit means preventing said door from being opened to a completely horizontal position, whereby said item being dispensed is prevented from being pushed onto the floor by said ejecting means.

* * * * *